US012710256B2

(12) United States Patent
Hagberg

(10) Patent No.: US 12,710,256 B2
(45) **Date of Patent: *Aug. 18, 2026**

(54) PROJECTILE AND FUZE WITH FIN

(71) Applicant: BAE SYSTEMS BOFORS AB, Karlskoga (SE)

(72) Inventor: Anders Hagberg, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 0 days.

This patent is subject to a terminal disclaimer.

(21) Appl. No.: 18/555,372

(22) PCT Filed: May 9, 2022

(86) PCT No.: PCT/SE2022/050447

§ 371 (c)(1),
(2) Date: Oct. 13, 2023

(87) PCT Pub. No.: WO2022/245267

PCT Pub. Date: Nov. 24, 2022

(65) Prior Publication Data

US 2024/0191980 A1 Jun. 13, 2024

(30) Foreign Application Priority Data

May 19, 2021 (SE) ..... 2100079-9

(51) Int. Cl.
*F42B 10/14* (2006.01)
*F41G 7/22* (2006.01)
(Continued)

(52) U.S. Cl.
CPC ..... *F42B 10/14* (2013.01); *F41G 7/2253* (2013.01); *F42B 10/26* (2013.01); *F42B 10/50* (2013.01); *F42B 10/64* (2013.01); *F42C 19/02* (2013.01)

(58) Field of Classification Search
CPC ..... F42B 10/00; F42B 10/14; F42B 10/50; F42B 10/64; F42C 19/00; F42C 19/02
See application file for complete search history.

(56) References Cited

U.S. PATENT DOCUMENTS 3,010,677 A 11/1961 Guthrie et al.
3,111,088 A * 11/1963 Fisk ..... F41G 7/2213 244/3.23

(Continued)

FOREIGN PATENT DOCUMENTS

CA 1271084 A 7/1990
FR 2916268 A1 * 11/2008 ..... F42B 10/14

(Continued)

OTHER PUBLICATIONS

International Search Report (Jun. 30, 2022) for corresponding International App. PCT/SE2022/050447.

(Continued)

*Primary Examiner* — Claude J Brown
(74) *Attorney, Agent, or Firm* — Husch Blackwell LLC

(57) ABSTRACT

A projectile is outfitted with a target finder and is intended to be fired from a launching device and includes one or several fins where the fins, upon being extended, cause the projectile to be urged into a controlled oscillating movement. A fuze is also provided.

17 Claims, 4 Drawing Sheets

(51) Int. Cl.

| | |
|---|---|
| ***F42B 10/26*** | (2006.01) |
| ***F42B 10/50*** | (2006.01) |
| ***F42B 10/64*** | (2006.01) |
| ***F42C 19/02*** | (2006.01) |

(56) References Cited

U.S. PATENT DOCUMENTS

| | | | | |
|---|---|---|---|---|
| 4,013,245 | A * | 3/1977 | Vanbuskirk | F41G 7/222 244/3.21 |
| 4,037,806 | A * | 7/1977 | Hirsch | F42B 10/64 244/3.28 |
| 4,431,147 | A * | 2/1984 | Paley | F42B 10/64 244/3.3 |
| 4,679,748 | A | 7/1987 | Blomqvist et al. | |
| 4,966,078 | A | 10/1990 | Schleimann-Jensen | |
| 5,155,294 | A * | 10/1992 | Vesa | F42B 10/16 244/3.28 |
| 5,280,752 | A | 1/1994 | Borgstroem et al. | |
| 5,439,188 | A * | 8/1995 | Depew, Jr. | F42B 10/64 244/3.21 |
| 5,669,581 | A | 9/1997 | Ringer | |
| 5,762,291 | A * | 6/1998 | Hollis | F42B 10/50 244/3.25 |
| 6,276,278 | B1 * | 8/2001 | Korpe | F42B 12/32 102/496 |
| 6,310,335 | B1 * | 10/2001 | Bonnet | F42B 10/50 244/3.29 |
| 6,325,325 | B1 * | 12/2001 | Bonnet | F42B 10/50 244/113 |
| 6,422,507 | B1 * | 7/2002 | Lipeles | F41G 7/305 244/3.13 |
| 6,502,785 | B1 * | 1/2003 | Teter | F42B 10/64 244/3.28 |
| 6,502,786 | B2 * | 1/2003 | Rupert | F42B 10/54 244/3.1 |
| 6,604,705 | B2 * | 8/2003 | Pellegri | F42B 10/64 244/3.21 |
| 6,685,143 | B1 * | 2/2004 | Prince | F42B 10/64 244/203 |
| 6,869,044 | B2 | 3/2005 | Geswender et al. | |
| 7,163,176 | B1 * | 1/2007 | Geswender | F42B 10/64 102/490 |
| 7,354,017 | B2 * | 4/2008 | Morris | F42B 10/54 102/501 |
| 7,506,587 | B1 * | 3/2009 | Anderson | F42B 12/08 102/473 |
| 8,026,465 | B1 * | 9/2011 | Fraysse, Jr. | F42B 10/54 244/3.22 |
| 8,319,164 | B2 * | 11/2012 | Martinez | F42B 10/14 244/3.21 |
| 8,552,351 | B2 * | 10/2013 | Geswender | F42B 10/64 244/3.27 |
| 9,040,885 | B2 * | 5/2015 | Morris | F42B 10/54 244/3.24 |
| 9,303,964 | B2 * | 4/2016 | Wurzel | F42B 15/01 |
| 9,429,400 | B1 * | 8/2016 | Sowle | F42B 10/62 |
| 9,939,238 | B1 * | 4/2018 | Sowle | F42B 10/00 |
| 10,203,188 | B1 * | 2/2019 | Sowle | F42B 10/14 |
| 10,323,917 | B2 * | 6/2019 | Carlqvist | B64C 5/12 |
| 11,009,322 | B2 * | 5/2021 | Malul | F42B 10/14 |
| 2001/0039898 | A1 * | 11/2001 | Bar | F42B 10/50 244/3.28 |
| 2002/0117580 | A1 * | 8/2002 | Rupert | F42B 10/54 244/3.24 |
| 2005/0056723 | A1 * | 3/2005 | Clancy | F42B 10/64 244/3.1 |
| 2006/0289694 | A1 * | 12/2006 | Bredy | F41G 7/2293 244/3.1 |
| 2007/0241227 | A1 * | 10/2007 | Zemany | F41G 7/2293 244/3.1 |
| 2008/0029641 | A1 * | 2/2008 | Carlson | F42B 10/64 244/3.24 |
| 2008/0029642 | A1 * | 2/2008 | Harnisch | F42B 10/64 244/3.28 |
| 2009/0283627 | A1 * | 11/2009 | Geswender | F42B 10/50 244/3.21 |
| 2016/0370159 | A1 * | 12/2016 | Bootes | F42B 12/24 |
| 2019/0368846 | A1 * | 12/2019 | Trouillot | F42B 14/064 |
| 2020/0348116 | A1 * | 11/2020 | Pettersson | F42B 10/50 |

FOREIGN PATENT DOCUMENTS

| | | | | |
|---|---|---|---|---|
| GB | 2251834 | A * | 7/1992 | F42B 10/661 |
| KR | 20130121671 | A * | 11/2013 | F42B 10/64 |
| WO | 2009103939 | A2 | 8/2009 | |
| WO | WO-2013119163 | A1 * | 8/2013 | F42B 10/50 |
| WO | 2020047367 | A1 | 3/2020 | |

OTHER PUBLICATIONS

European Search Report (Feb. 19, 2025) for corresponding European App. 22805073.8.

* cited by examiner

PROJECTILE AND FUZE WITH FIN

BACKGROUND AND SUMMARY

The present invention relates to a projectile provided with one or several fins where the projectile is intended to be fired from a launching device. The projectile comprises one or several extensible fins which, when extended, affect the properties of the projectile in the projectile's trajectory. In addition, the invention consists of or comprises a fuze intended for projectile, whereby said fuze comprises one or several fins provided for purposes of actuating the projectile upon being extended.

Missile projectiles, such as projectiles for artillery, are fired at target objects. The projectiles are intended to act against a target object and can e.g. steer towards the target object, by means such as final phase control, or act against the target object by bursting at an appropriate time, or in other ways causing action against the target object, for example by splinters acting on the target object. Final phase control, i.e. the steering at the end of the projectile's trajectory near the target, can e.g. be achieved by the projectile being outfitted with a target finder that scans the target area for target object and steers the projectile towards an identified target object. near the target object, and can thus act by striking the target object or by means of splintering action upon bursting in the proximity of the target object. Alternatively, the projectile can act with forward-directed splinters when the target finder has detected a target object and initiates action against the target object, for example by bursting at the right time and thus causing splinter action against the target object, for example by forward-directed splintering action.

Patent document WO 2009/103939 A2 shows asymmetrically arranged fins for purposes of controlling projectiles. The patent document does not demonstrate how the target finder's target search area is affected.

Additional problems which the invention seeks to solve will become apparent in connection with the following detailed description of the various embodiments.

By extending a fin during a projectile's movement towards a target object or target area, an oscillating movement on the projectile can be achieved. The oscillation can e.g. be in the order of 10-20 degrees. The oscillation in combination with the rotation of the projectile means that a conical area can be scanned with a sensor provided in the projectile.

The invention consists of or comprises a projectile outfitted with a target finder, intended to be fired from a launching device, comprising one or several fins where the fins, upon being extended, cause the projectile to be urged into a controlled oscillating movement.

According to additional aspects of the projectile according to the invention, the following applies:

- that the projectile is outfitted with a fin.
- that fins are affixed to the projectile, in the longitudinal direction of the projectile, in a range between a factor of 0.1 of the caliber of the projectile to a factor of 2 of the caliber of the projectile, from the tip of the projectile.
- that the radial extent of the fins relative to the surface of the projectile, in the extended position, is in the range between a factor of 0.1 of the caliber of the projectile and a factor 1 of the caliber of the projectile.
- that the width of the fins, the extent of the fin around the projectile in the outer radius of the projectile, in the extended position, is in the range between a factor of 0.1 of the circumference of the projectile and a factor of 0.5 of the circumference of the projectile.
- that fins are cylindrically designed with a diameter of 1 mm up to 10 mm.
- that the fins are variably adjustable between a fully extended position and a fully retracted position.
- that the projectile is outfitted with two fins.
- that fins are provided at an angle $\alpha$ of between 0.1 degrees and 5 degrees.

In addition, the invention consists of or comprises a fuze, to be affixed to a projectile intended to be fired from a launching device, where the fuze is outfitted with a target finder and comprising one or several fins characterized in that the fins, after being extended, cause the projectile, where the fuze is mounted on a projectile, to end up in a controlled oscillating movement.

According to further aspects of the fuze according to the invention, the following applies;

- that fins are provided on the fuze, in the longitudinal direction of the fuze, in a range between a factor of 0.1 of the caliber of the projectile and a factor 2 of the caliber of the projectile, from the tip of the fuze.
- that the radial extent of the fins relative to the surface of the fuze, in the extended position, is in the range between a factor of 0.1 of the caliber of the projectile and a factor of 1 of the caliber of the projectile.
- that the width of the fins, the extent of the fins around the fuze in the outer radius of the fuze, in the extended position, is in a range between a factor of 0.1 of the fuze circumference and a factor of 0.5 of the circumference of the fuze at the position of the fuze where the fins are affixed
- that fins are cylindrically designed with a diameter of 1 mm up to 10 mm.
- that fins are variably adjustable between fully extended position and fully retracted position.
- that the fuze is provided with two fins.
- that fins are provided at an angle $\alpha$ of between 0.1 degrees and 5 degrees.

The invention demonstrates a simple method for causing an oscillation of a projectile with a fin, which, combined with the rotation of the projectile, means that a conical area can be scanned with a target finder provided in the projectile. When a target is observed by the target finder in the scanned target area, the projectile can act against the target. The target finder scans the target area for the target object and can steer the projectile towards an identified target object and can thus act with impact on the target object or by means of a shatter effect by bursting in the vicinity of the target object. Alternatively, the projectile can act with forward splitter when the target detector has detected a target object and initiates action against the target object, for example by bursting at the right time and thus causing splinter action against the target object, for example by forward splitter action.

BACKGROUND AND SUMMARY

The invention will be described below by reference to the figures that are included there:

DETAILED DESCRIPTION

Figure 1:
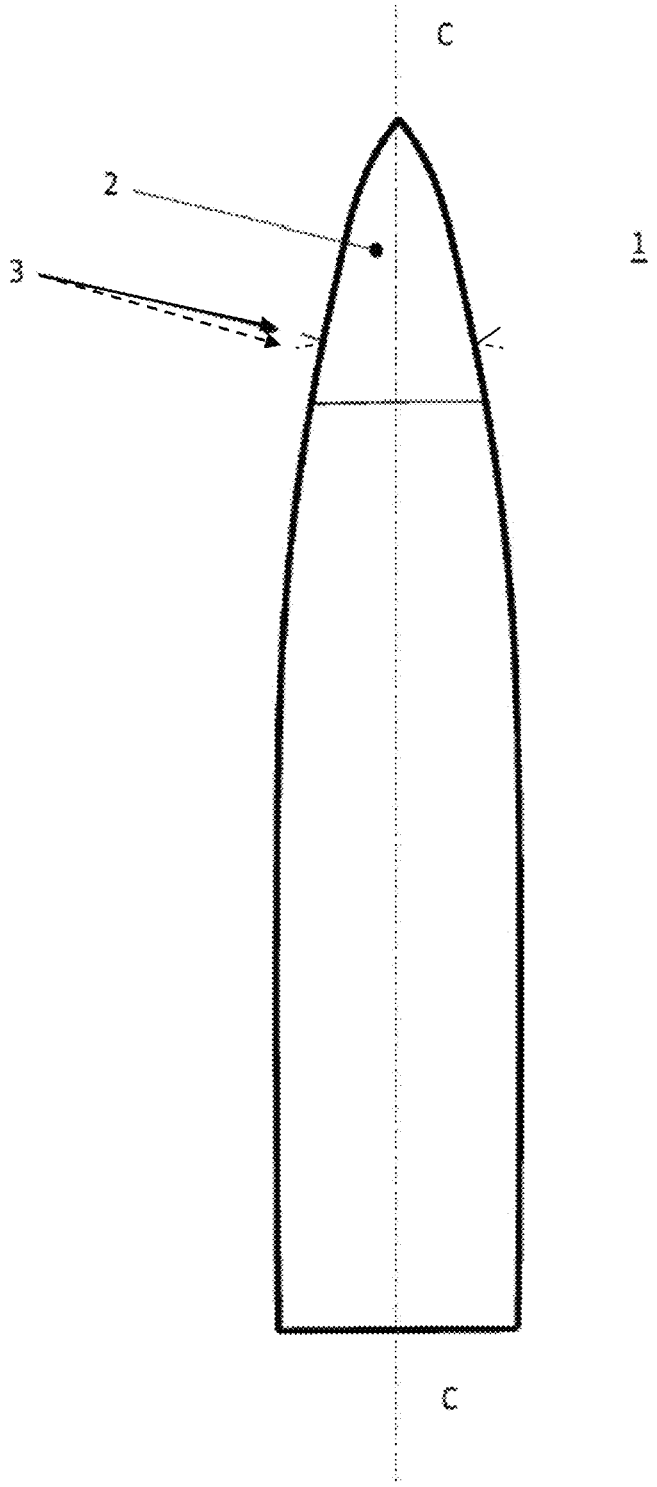
FIG. 1 shows a projectile outfitted with a fuze including an extended fin according to one embodiment of the invention.

FIG. 1 shows a projectile 1 intended to be launched from a launching device such as a cannon with a fuze 2, where the fuze can be mounted as a separate unit on the projectile or designed as part of projectile 1. In the shown embodiment, projectile 1 is affected by fins 3, which are extended from projectile 1. Fin 3 can also be called panel, brake panel, brake, wing, spoiler or canard. When fin 3 is retracted, projectile 1 is rotationally symmetrical around a center line C shown in the figure, where the center line is provided in the longitudinal direction of the projectile. When fin 3 is extended, projectile 1 is no longer rotationally symmetrical about shown center line C. Fin 3 may be designed in the form of a cylinder with a diameter of 1 mm-10 mm. Fin 3 can also be designed in the form of a rectangular panel with a thickness, the width of the panel being in the same direction as in the longitudinal direction of the projectile, of between 1 mm-4 mm and a width, the width of the panel being in a direction perpendicular to the thickness, of between 2 mm-15 mm or on a factor between 0.1-0.5 of the projectile's circumference where the circumference refers to the circumference of the projectile at the caliber of the projectile, i.e. where the projectile has the highest diameter. Fin 3 can be deposited radially from the surface of the projectile body between 1 mm-15 mm or on a factor between 0.1-1 of the projectile caliber. The longitudinal position of the fin is 20 mm-150 mm or on a factor between 0.1-2 of the caliber of the projectile, measured from the tip on the projectile. The position in the longitudinal direction of the projectile is in relation to the center of gravity of the projectile, in order to cause a momentum force on the projectile when fin 3 is extended. The position can also be between a factor of −2.5-2.5 times the projectile caliber relative to the center of gravity of the projectile. In the event that more than one fin 3 is desired, an odd number of fins 3 are preferably provided distributed around the projectile body. Preferably, there is a single fin 3 affixed to the projectile.

Figure 2:
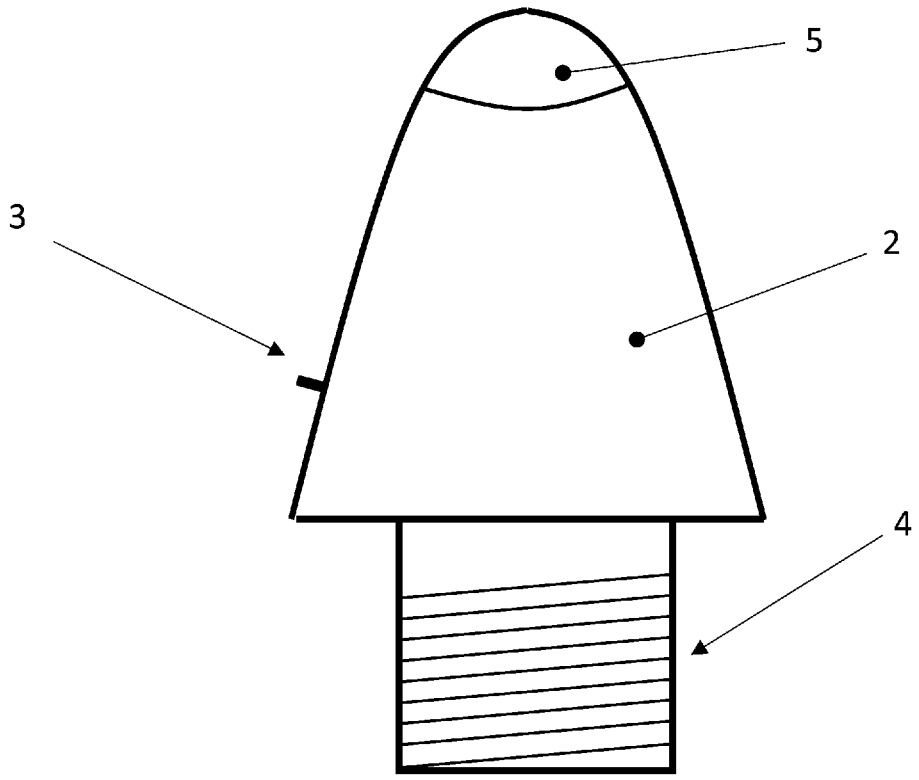
FIG. 2 shows a fuze with a fin in extended position according to one embodiment of the invention.

FIG. 2 shows fuze 2 with fin 3 extended. Activation and extension of fin 3 can take place by mechanical, electromechanical, chemical or pyrotechnic device. Fuse 2 is provided with a thread 4 to be attached to a grenade body of a projectile 1. The fuze is outfitted with a target finder 5 which can e.g. be an optical target finder.

Figure 3:
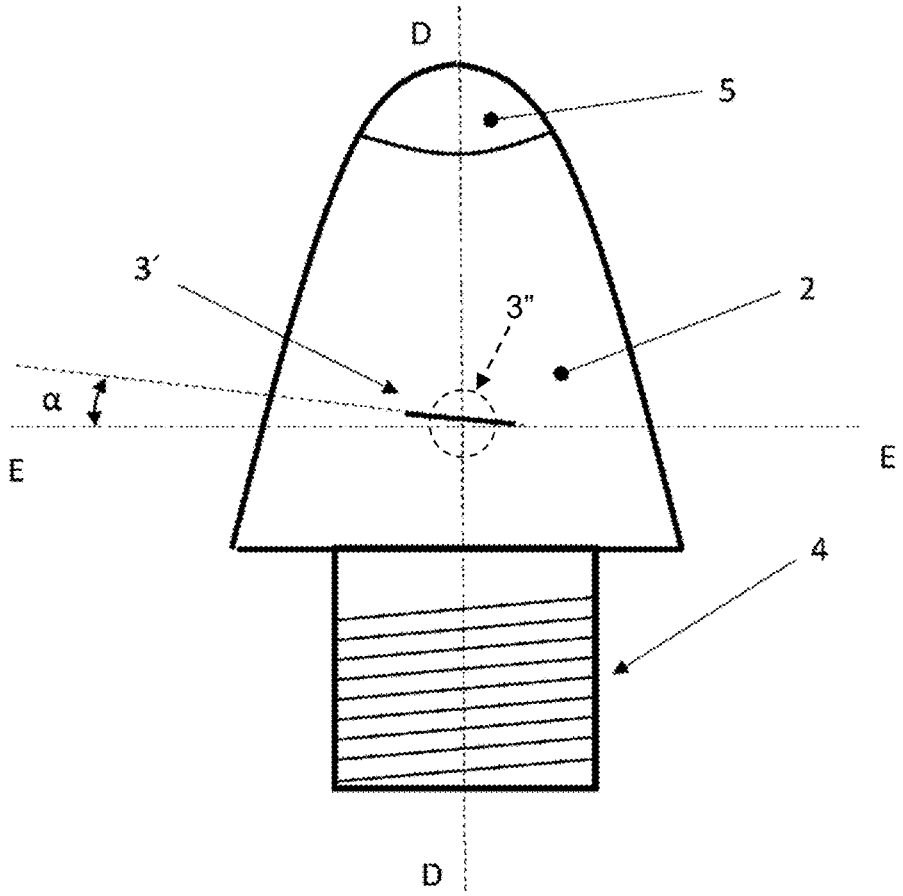
FIG. 3 shows an fuze with a fin in extended position according to an alternate embodiment of the invention.

FIG. 3 shows fuze 2 with an inclined fin 3' extended and, in phantom, a cylindrical fin 3". The fin 3' is inclined relative to a line E-E perpendicular to the center line D-D of the fuze/projectile. Line E-E is perpendicular to the center line D-D which passes through the center of the circularly symmetrical fuze. Fin 3' is inclined at an angle $\alpha$ relative to the line E-E. The angle is preferably in the range of 0.1 degrees to 5 degrees. The activation and extension of inclined fin 3' may take place by means of a mechanical, electromechanical, chemical or pyrotechnic device. In the event that more than one fin 3' is used, when the fins 3' are inclined, both an odd number of fins 3' and an even number of fins 3' distributed around the projectile body can be used. Fuse 2 is provided with a thread 4 to be attached to a grenade body of a projectile 1. The fuze is outfitted with a target finder 5 which can e.g. be an optical target finder.

Figure 4:
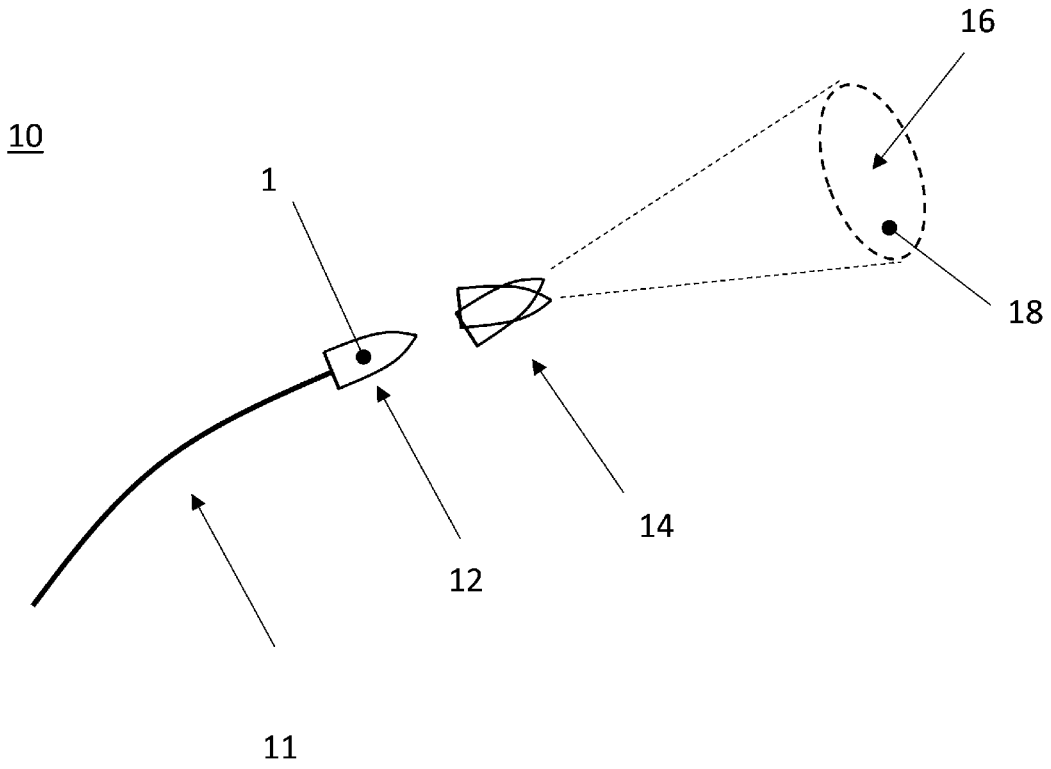
FIG. 4 shows a projectile in the trajectory on its way to a target object when the fins are extended from the projectile according to an embodiment of the invention.

FIG. 4 shows the firing course 10 for an embodiment of the invention. Projectile 1 travels in projectile trajectory 11 on its way to a target object 16. Position 12 shows projectile 1 on its way to the target object 16 in the target area 18 before a fin has been extended from projectile 1. Once the fin is extended from the projectile, an oscillation of the projectile begins, which is shown in position 14. When projectile 1 oscillates, a target area 18 can be scanned with a target finder arranged in the projectile. When the projectile oscillates in the trajectory at the same time as the projectile rotates, the scanned target area 18 will be mainly circular and the target finder will be able to search the entire target area 18. When a target object 16 has been detected by the target finder, the projectile can be steered towards the target object 16 or the projectile can burst, or in other ways, act against the target object, e.g. by means of forward-acting splinters. The oscillating movement can be adapted based on the target finder and/or the target object and/or the design of the projectile by varying the design of the fin and/or how far the fin extends or at what frequency or interval the fin extends and/or at what speed and/or acceleration the fin extends. By varying the extension of the fin, the size and appearance of the target area can be changed, e.g. if the target finder identifies an object, the target area can be delimited to the surroundings of the identified object.

Fin 3, 3' is extended from the fuze 2 or from projectile 1 in the trajectory of projectile 1 to affect the trajectory of the projectile. Fin 3, 3' can e.g. be based on the target of and/or the position of projectile 1. The target of projectile 1 can be programmed or otherwise stored in projectile 1 prior to launch, but can also be communicated to projectile 1 during the projectile's trajectory between the launch device and the target by means of communication equipment such as a radio transmitter. The position of projectile 1 is determined on the basis of a navigation system/control system mounted in the projectile that receives the current position from satellite navigation and/or inertial navigation or other navigation system. The control system can continuously evaluate the current position relative to the target position and the calculated speed to control and/or optimize the projectile's trajectory.

The target of projectile 1 can also be determined by means of a target finder 5 included in projectile 1, which identifies a target and possibly steers projectile 1 towards that target. Control of projectile 1 can e.g. take place by means of the braking ability, which entails longitudinal steering, and also include lateral steering with intended controls. The target of projectile 1 can also be combated by the projectile in the projectile's trajectory, e.g. by means of forward-acting splinters.

At a suitable position determined from the control system, a lock is initiated which keeps the fin in the retracted position, which releases fin 3, 3' or fins 3, 3'. Fin 3, 3' or fins 3, 3' are extended by means of the rotational force of the projectile and/or by means of a spring mounted in the extension mechanism or another elastically deformed and prestressed actuating device or by means of an actuator such as an electric motor.

Upon extension of fin 3, 3' or fins 3, 3', projectile 1 will commence a predetermined oscillating movement, based on the extension, design, size, and location of fin 3, 3'. Extension of the fin will also affect the rotation of the projectile in the event that the projectile is rotationally stabilized and thus rotating.

The projectile 1 is designed with an odd number of fins 3, 3', e.g. one, three, five or seven fins 3, 3' or with an even number of fins 3, 3' for example two, four, six or eight fins 3, 3'. The fin or fins 3, 3' extend radially from the projectile. The extension mechanism in one embodiment can only extend the fin or fins 3, 3'. Other mechanisms, not shown in the figure, can extend the fin completely or partially and retract the fin completely or partially.

An alternative embodiment, not shown in the figure, of the extension mechanism means that both the extension and retraction of fins 3, 3' can be regulated on the basis of both speed and level or length. Extension and retraction are performed by means of a control system mounted in the projectile for the creation of variable oscillation effect on the projectile 1 by the fins 3, 3' being extended completely, partially or alternately in and out of the projectile 1. By controlling the extension mechanism, the oscillation effect can be adjusted variably to variably control the oscillation of the projectile 1.

The invention is not limited to embodiments specifically shown, but can be varied in different ways within the framework of the claims.

For instance, it is clear that the number, size, material and shape of the elements and details outfitted with a fin are to be adapted according to the type(s) of projectile(s) and weapon systems and/or other construction-related properties, which are applicable to each individual case.

It is clear that the projectile embodiments described above with a fin may include several different dimensions and projectile types depending on the area of use and barrel width. However, the above refers to at least the most common types of grenades today of between about 20 mm-203 mm.

The invention claimed is:

1. A projectile adapted to be launched from a launching device, the projectile comprising a target finder, and one or more extensible fins, wherein the one or more fins, upon launching of the projectile and extension of the fins, cause the projectile to be put into a controlled oscillating movement to provide a conical scan area of increased size compared to a non-oscillating target scan area for the target finder around the original trajectory, said oscillating movement characteristic of one or more of a selected fin shape of the one or more fins, an amount of fin extension of the one or more fins, a frequency or interval of fin extension of the one or more fins, a speed of fin extension of the one or more fins, and an acceleration of fin extension of the one or more fins, and wherein the target finder controls the projectile flight after locating an identified target and delimits the oscillations to focus on the identified target.

2. The projectile according to claim 1, wherein the one or more fins comprises a single fin.

3. The projectile according to claim 1, wherein each fin of the one or more fins is arranged on the projectile, in a longitudinal direction of the projectile, in a range between a factor of 0.1 of a projectile caliber to a factor 2 of the projectile caliber, from the tip of the projectile.

4. The projectile according to claim 1, wherein a radial extent of each fin of the one or more fins relative to a surface of the projectile, in an extended position of the fin, is in a range between a factor of 0.1 of a caliber of the projectile and a factor 1 of the caliber of the projectile.

5. The projectile according to claim 1, wherein a width of each fin of the one or more fins is in a range between a factor of 0.1 of a circumference of the projectile and a factor of 0.5 of the circumference of the projectile.

6. The projectile according to claim 1, wherein the one or more fins are variably adjustable between a fully extended position and a fully retracted position.

7. The projectile according to claim 1, wherein the one or more fins comprises two fins.

8. The projectile according to claim 1, wherein each fin of the one or more fins is disposed at an angle $\alpha$ of between 0.1 degrees and 5 degrees to a plane perpendicular to a longitudinal axis of the projectile.

9. A fuze adapted to be affixed to a projectile, the fuze comprising a target finder and one or more extensible fins, wherein the one or more fins, upon launching of the projectile to which the fuze is affixed and extension of the one or more fins, cause the projectile to which the fuze is affixed to be put into a controlled oscillating movement to provide a conical target scan area of increased size as compared to a non-oscillating target scan area around the original projectile trajectory, the oscillating movement characteristic of one or more of selection of a fin shape of the one or more fins, an amount of fin extension of the one or more fins, a frequency or interval of fin extension of the one or more fins, a speed of fin extension of the one or more fins, and an acceleration of fin extension of the one or more fins, and wherein the target finder controls the projectile flight to eliminate undue oscillation movement after locating an identified target.

10. The fuze according to claim 9, wherein the one or more fins of the fuze comprises a single fin.

11. The fuze according to claim 9, wherein each fin of the one or more fins is arranged on the fuze, in the longitudinal direction of the fuze, in the range between a factor of 0.1 of a caliber of the projectile and a factor of 2 of the caliber of the projectile, from the tip of the fuze.

12. The fuze according to claim 9, wherein a radial extent of each fin of the one or more fins relative to a surface of the fuze, in an extended position of the fin, is in a range between a factor of 0.1 of a caliber of the projectile to a factor 1 of the caliber of the projectile.

13. The fuze according to claim 9, wherein a width of each fin of the one or more fins is in a range between a factor of 0.1 of a circumference of the fuze and a factor of 0.5 of the circumference of the fuze at a position on the fuze where the fins are situated.

14. The fuze according to claim 9, wherein the one or more fins are variably adjustable between a fully extended position and a fully retracted position.

15. The fuze according to claim 9, wherein the one or more fins comprises two fins.

16. The fuze according to claim 9, wherein each fin of the one or more fins is disposed at an angle $\alpha$ of between 0.1 degrees and 5 degrees to a plane perpendicular to a longitudinal axis of the projectile.

17. A method of launching a projectile from a launching device, the projectile comprising one or more extensible fins and an optical target finder, the method comprising:

launching the projectile; and causing the projectile to be put into a controlled oscillating movement to provide a conical scan area of increased size compared to a non-oscillating target scan area for the optical target finder around the original projectile trajectory, said oscillating movement by extending at least one fin of the one or more fins and one or more of selecting a fin shape for the at least one fin of the one or more fins, selecting an amount of fin extension of the at least one fin of the one or more fins, selecting a frequency or interval of fin extension of the at least one fin of the one or more fins, selecting a speed of fin extension of the at least one fin of the one or more fins, selecting an acceleration of fin extension of the at least one fin of the one or more fins and further controlling the projectile flight to eliminate undue oscillation movement after locating an identified target.

* * * * *